United States Patent [19]

Philips

[11] 4,342,416

[45] Aug. 3, 1982

[54] TWO-PIECE RECLOSABLE CONTAINER

[75] Inventor: Nicholas A. Philips, Glendale Heights, Ill.

[73] Assignee: Container Corporation of America, Chicago, Ill.

[21] Appl. No.: 225,308

[22] Filed: Jan. 15, 1981

[51] Int. Cl.[3] ..... B65D 5/32

[52] U.S. Cl. ..... 229/23 BT; 229/23 R; 229/38; 220/415

[58] Field of Search ..... 229/23 BT, 23 R, 37 R, 229/38; 220/411, 415, 416

[56] References Cited

U.S. PATENT DOCUMENTS

| | | | |
|---|---|---|---|
| 2,713,964 | 7/1955 | Repking et al. | 229/38 |
| 2,926,777 | 3/1960 | Maguire | 229/37 R |
| 3,040,960 | 6/1962 | Younger | 229/38 |

OTHER PUBLICATIONS

Schiffen Haus Packaging Corp., *Handbook of Corrugated Fiberboard Boxes and Products,* Fiber Box Association, 1968, pertinent pages: p. 32, lower rt. hand corner (Fths).

*Primary Examiner*—William Price
*Assistant Examiner*—Gary E. Elkins
*Attorney, Agent, or Firm*—Richard W. Carpenter; Davis Chin

[57] ABSTRACT

A two-piece reclosable container includes a reclosable closure arrangement for closing and reclosing the upper end of an inner body. The inner body consists of a pair of first closure flaps and a pair of second closure flaps. Each of the second flaps consist of a triangular center section and a pair of side sections. The side sections are interposed between and parallel to the center sections and the first closure flaps in a bellows-type arrangement when the inner container is initially closed. Thereafter, the side sections are separable from the center sections and are insertable between the corresponding side walls of the inner and outer containers when the inner container is reclosed after it has been opened initially.

1 Claim, 10 Drawing Figures

TWO-PIECE RECLOSABLE CONTAINER

BACKGROUND OF THE INVENTION

1. Field Of The Invention

This invention relates to paperboard containers, and more particularly to a two-piece reclosable container, including inner and outer tubular bodies with reclosable flaps foldably joined to the upper end of the inner body and being insertable between the bodies upon reclosure.

2. Description Of The Prior Art

A state of the art search directed to the subject matter of this application uncovered the following patents: U.S. Pat. Nos. 459,542; 508,571; 915,579; 915,544; 2,652,970; 2,713,964; 2,835,431; 2,926,777; 2,936,239; 2,936,941; 3,007,622; 3,040,960; 3,157,345; 3,248,039; 3,285,492; 3,365,114; 3,523,635; 3,921,896.

None of the prior art uncovered in the search disclosed a two-piece container having a closure arrangement like that of the present invention wherein certain flaps portions could be separated from other flap portions and reinserted between inner and outer containers to effect a firm reclosure arrangement.

SUMMARY OF THE INVENTION

It is an object of the invention to provide a two-piece closure arrangement consisting of a pair of inner and outer sleeves in telescoping relationship and including closure flaps on the inner body which can be closed in a bellows arrangement prior to initial opening and which thereafter can be closed in a different manner to afford a positive lock.

A more specific object of the invention is a provision of a closure arrangement wherein certain of the closure flaps are detachably secured to each other so that after initial opening, instead of having a bellows arrangement, certain of the flaps can be inserted between corresponding walls of inner and outer bodies to form a positive locking arrangement.

These and other objects of the invention will be apparent from an examination of the following description.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
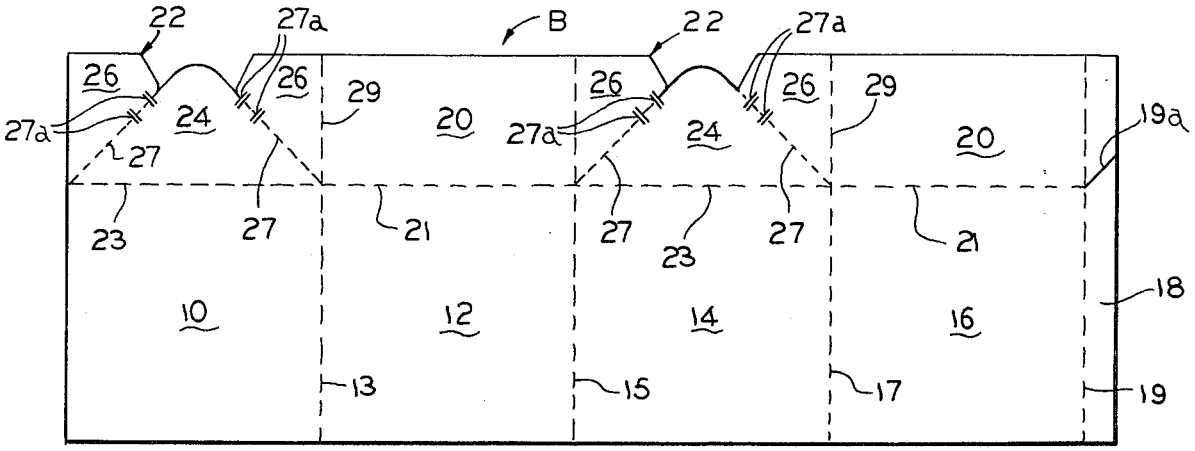
FIG. 1 is a plan view of a blank of foldable sheet material from which the inner body illustrated in the package shown in the other views may be formed.
Figure 2:
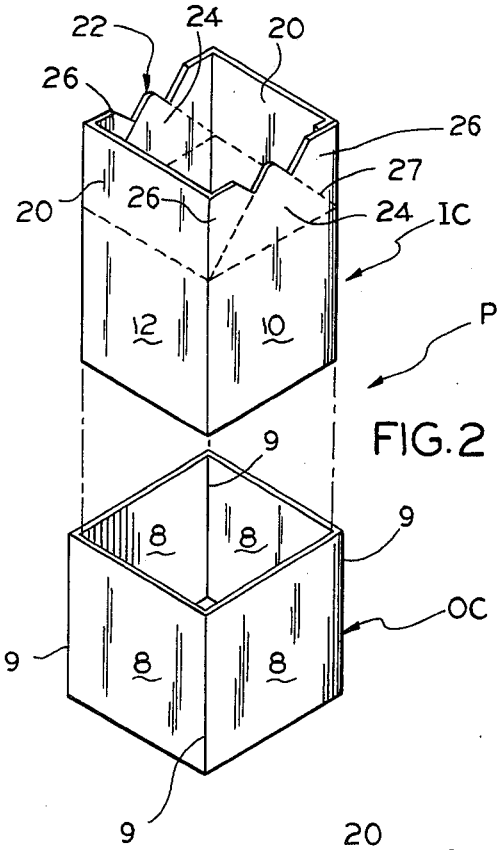
FIG. 2 is an exploded perspective view illustrating the inner and outer bodies of the invention.

Referring now to the drawings for a better understanding of the invention and particularly to FIGS. 1 and 2, it will be seen that the novel package indicated generally at P includes a pair of generally tubular inner and outer bodies IC and OC, respectively, which are telescoped one within the other to form a composite package.

Outer body OC may be a conventional half slotted container comprising opposed pairs of side walls 8 joined to each other along parallel fold lines 9 to form a tubular structure or sleeve having conventional closure flaps at the lower end of the body (not shown) to close the lower end in a conventional manner.

Figure 3:
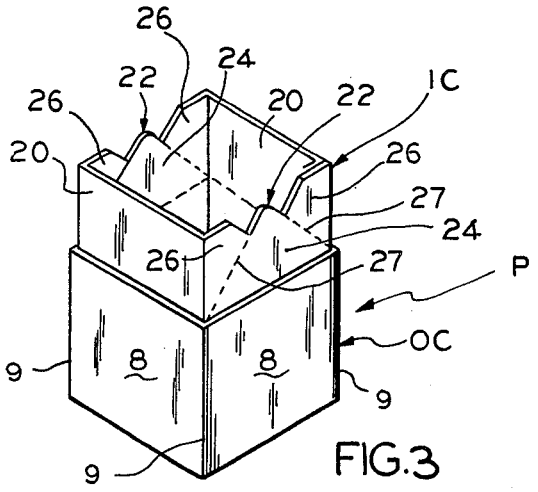
FIG. 3 is a perspective view of the inner and outer bodies, as seen in the completely open position.
Figure 4:
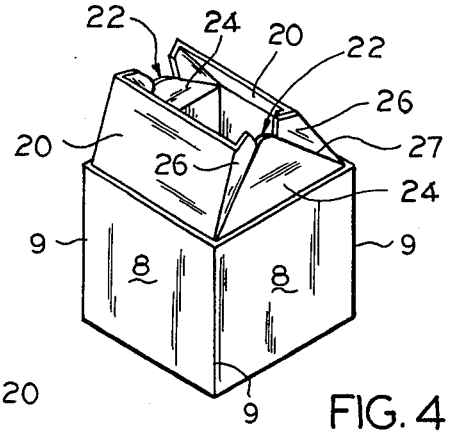
FIG. 4 is a view similar to FIG. 3 but illustrating the manner in which the closure is effected initially.
Figure 5:
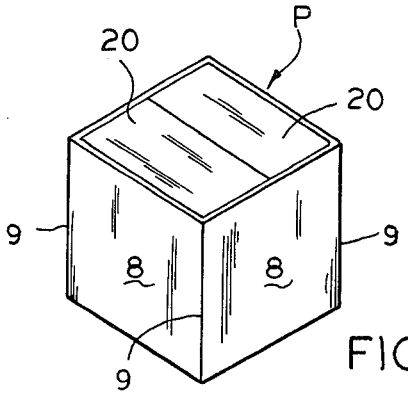
FIG. 5 is a view similar to FIG. 4 but with the container shown in a closed position.

The novelty in the invention resides in the inner body IC which is also a tubular structure and which is telescoped within the outer body OC, as best seen in FIGS. 3, 4, and 5.

It will be understood that the inner body IC may be formed from a unitary blank B of paperboard illustrated in FIG. 1. Inner body IC includes first, second, third, and fourth sidewalls 10, 12, 14, 16, respectively, and glue flap 18 which are foldably joined to each other along parallel fold lines 13, 15, 17, and 19, respectively, with glue flap 18 being secured to first side wall panel 10 to form a tubular structure as illustrated in FIG. 3. The lower end of the structure is open, but a unique closure arrangement is provided for the upper end of the structure.

Still referring to FIG. 1 it will be seen that second and fourth side wall panels 12 and 16 are each provided at their upper ends with conventional rectangular closure flaps 20 which are foldably joined along fold lines 21 to the upper edges of side wall panels 12 and 16.

First and third side wall panels 10 and 14 have joined to their upper edges a pair of special closure flaps indicated generally at 22. Each of the closure flaps 22 includes a preferably triangular center section 24 which is foldably joined at its lower edge along fold line 23 to the related side wall panel and which has upwardly converging side edges. Each flap 22 also includes a pair of side sections 26 which are foldably and detachably joined to the side edges of related center section 24 along weakened cut score lines 27. Separations in the score line, as indicated at **27*a***, keep the center section from being detached from the side sections accidentally prior to the time it is desired to so detach the sections from each other.

Each of the side sections 26 is also foldably joined to an adjacent side edge of a related flap 20 along fold line 29.

Now to describe the operation of the invention, it will be seen by an examination of FIGS. 3, 4, and 5 that, in order to initially close the inner body closure arrangement, center sections 24 are folded downwardly with side sections 26 being sandwiched between the center sections 24 and adjacent flaps 20 in a conventional bellows arrangement.

Figure 6:
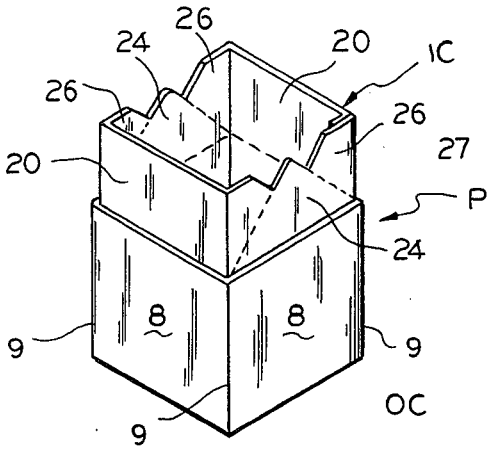
FIG. 6 is a view similar to FIG. 3 and showing the container in an open position.
Figure 7:
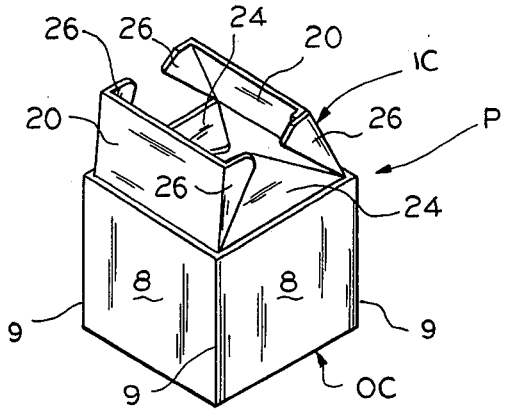
FIG. 7 is a view similar to FIG. 6 but showing portions of the closure flap separated from each other as a prerequisite to being locked in an alternate closure arrangement.
Figure 8:
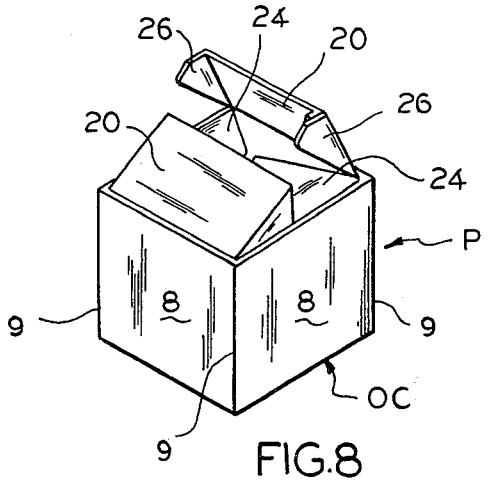
FIGS. 8 and 9 are similar to FIG. 7 but illustrate various stages in closing the upper end of the container.
Figure 9:
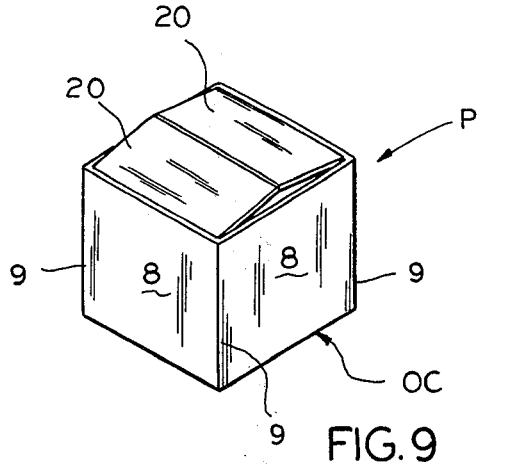
Figure 10:
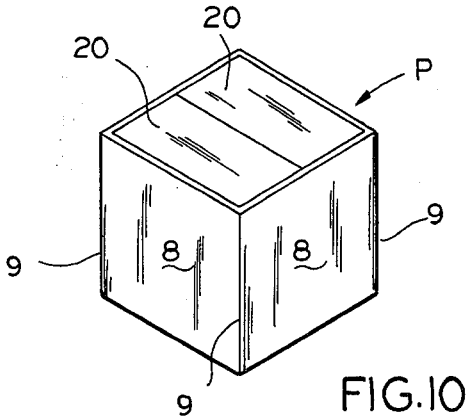
FIG. 10 is a view similar to FIG. 9 but showing a container in a completely closed position.

After the inner body has been initially opened, as shown in FIG. 6, in order to have a locking type reclosure arrangement, center sections 24 may be easily detached from side sections 26, so that when the container is closed, the center sections 24 are first folded inwardly at right angles to the side panels to which they are attached, then the opposed flaps 20 are folded downwardly so as to overlie the center sections of the other flaps, and at the same time and side sections are folded at right angles and sandwiched between corresponding inner body sidewall panels and outer body sidewalls as shown in FIGS. 8, 9, and 10. Thus, a simpl locking arrangement is provided that will prevent the container from opening accidentally.

I claim:

1. In a two-piece reclosable container, the combination of:

(a) an outer body having a closed bottom and including: opposed pairs of side walls foldably joined to each other to form a tubular structure open at both the upper and lower ends thereof;

(b) an inner body telescoped within said outer body, and including opposed pairs of side walls foldably joined to each other to form a tubular structure open at both the upper and lower ends thereof;

(c) reclosable closure arrangement means for closing and reclosing the upper end of said inner body comprising:

(i) a pair of opposed, generally rectangular, first closure flaps foldably joined to the upper ends of one opposed pair of side walls;

(ii) a pair of second closure flaps joined to the upper ends of the other pair of side walls; and each including:

(A) a generally triangular center section foldably joined at its lower edge to a related side wall and having upwardly converging side edges;

(B) a pair of side sections disposed between said center section and said first closure flaps;

(C) said side sections having outer edges foldably joined to adjacent side edges of said first closure flaps and having inner edges detachably joined to adjacent said edges of said center section;

(D) said second flap side sections being interposed between and parallel to said center sections and said first flaps in a bellows-type arrangement when said inner container is initially closed, said side sections being separable from said center sections and being insertable between corresponding side walls of said inner and outer containers when said inner container is reclosed after it has been opened initially.

* * * * *